United States Patent [19]

Pollard

[11] Patent Number: 4,944,532

[45] Date of Patent: Jul. 31, 1990

[54] MULTIPLE-PART TRAVELERS' CHECK PROVIDING ENHANCED SECURITY AND PREVENTION OF UNAUTHORIZED USE

[76] Inventor: Albert C. Pollard, Pollard Properties, Inc., P.O. Box 266, Irvington, Va. 22480

[21] Appl. No.: 354,565

[22] Filed: May 22, 1989

[51] Int. Cl.[5] ..... B42D 15/00

[52] U.S. Cl. ..... 283/70; 283/74; 283/81; 283/86; 283/58

[58] Field of Search ..... 283/70, 58, 57, 81, 283/86, 85, 74

[56] References Cited

U.S. PATENT DOCUMENTS

| | | | |
|---|---|---|---|
| 707,891 | 8/1902 | Alexander | 283/71 |
| 1,542,692 | 6/1925 | Gentry et al. | 283/57 |
| 3,455,576 | 7/1969 | Hammerling | 283/114 |
| 3,950,015 | 4/1976 | Shrock | 283/70 |

FOREIGN PATENT DOCUMENTS

| | | | |
|---|---|---|---|
| 2412415 | 8/1979 | France | 283/77 |
| 2181993 | 5/1987 | United Kingdom | 283/58 |

*Primary Examiner*—Hien H. Phan
*Assistant Examiner*—Eugenia H. Jones
*Attorney, Agent, or Firm*—Sughrue, Mion, Zinn, Macpeak & Seas

[57] ABSTRACT

For issuance of travelers' checks, the checks themselves are provided, as is a record sheet containing validation stamps, in serial number order, corresponding to the serial numbers on the issued travelers' checks. In order for a check to be negotiable, a matching validation stamp must be affixed to the check. Removal of each validation stamp from the record sheet provides a tally of unused checks.

4 Claims, 1 Drawing Sheet

MULTIPLE-PART TRAVELERS' CHECK PROVIDING ENHANCED SECURITY AND PREVENTION OF UNAUTHORIZED USE

BACKGROUND OF THE INVENTION

The present invention represents an improvement in security of negotiable instruments, particularly travelers' checks.

Travelers' checks are negotiable instruments which are purchased by a customer from a bank or other financial institution. The customer has had to sign such checks in two places, at two different times. One signature is provided by the customer when the checks are purchased, and the other signature is provided by the customer for each check which is to be cashed, at the time of cashing. The merchant, salesperson, or other party honoring the travelers' check then compares the two signatures to determine whether they are the same.

Such comparison has been the only way to prevent unauthorized use of travelers' checks after purchase by the customer. Further, prior to purchase, there are no signatures on the checks, so that the travelers' checks must be handled with the same care and level of security as cash.

Various approaches have been taken to enhancing security of negotiable instruments, to provide alternatives or additional measures to mere signature comparison. U.S. Pat. No. 1,542,692 discloses a negotiable instrument (a financial certificate, such as a stock certificate or a bond) which is printed as a single piece and then is separated into two pieces, each of which is void without the other piece. Each of the two pieces has the same serial number on it. Part of each piece consists of a set of detachable coupons, also bearing the same serial number on it. Each piece of the overall certificate is mailed separately to the owner. Obviously, this technique is applicable only to single instruments, and not to multiple instruments.

Other approaches, such as that shown in U.S. Pat. No. 3,950,015, have required the issuance of a separate photo ID by the institution issuing the travelers' checks. While this may facilitate issuance of additional travelers' checks, as indicated in that patent, the issuance of the photo ID represents a significant additional burden for the institution.

A second technique, disclosed in U.S. Pat. No. 3,455,576, is known where periodic payments, as for example mortgage or rent payments, are to be made. As described, a separate label bearing the payee's signature is provided, the label to be affixed to the back of a check, in addition to requiring a separate signature, in order for the check to be negotiable. The check could be color-coded, the color corresponding to the label to be affixed. Only the payee would have the required label, and so only the payee would, theoretically, be able to cash or deposit the check.

Another technique using labels is shown in U.S. Pat. No. 707,891, except that the separate labels contain specific denominations, a plurality of labels thus being required in correspondence to the amount on the front of the check.

While all of the foregoing approaches have merit, none has the feature of providing security from the time of printing to the time of cashing, along with a record keeping function, for negotiable instruments which may be transferred at any time.

SUMMARY OF THE INVENTION

In view of the foregoing, it is one object of the invention to provide security against unauthorized use of traveler's checks from the time of manufacture until the customer cashes them.

It is another object of the invention to provide an automatic form of record keeping so that the customer can keep track of which checks have been used.

It is yet another object of the invention to provide security to the issuer against fraudulent collection of refunds for stolen checks.

In accordance with the foregoing and other objects, the inventive travelers' check disclosed and claimed herein includes a check with a space for a customer's signature, and a space for affixing of a label which bears a serial number, and preferably also a value of the check. The label may be one of a set of labels which are provided separately to a customer on a record keeping sheet bearing a series of labels in serial number sequence.

BRIEF DESCRIPTION OF THE DRAWINGS

The foregoing and other objects and features of the invention will become apparent in the following detailed description which references the accompanying drawings, in which.

DETAILED DESCRIPTION OF THE PREFERRED EMBODIMENT

Figure 1:
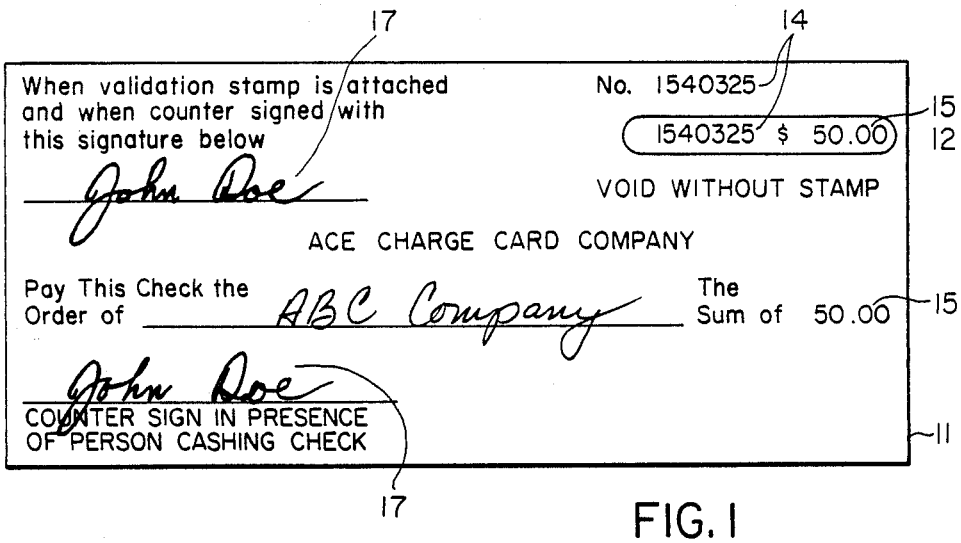
FIG. 1 shows a travelers' check, in accordance with the invention, to which a validation stamp is attached.

FIG. 1 shows a travelers' check 11 with a validation stamp 12 attached. Both the stamp 12 and the check 11 have matching serial numbers 14 and the monetary value of the check 15. Both the stamp 12 and check 11 are made so as to be difficult to duplicate. For example, a holographic image, such as that provided on credit cards nowadays, could be placed on both the stamp 12 and the check 11. The check 11 may be similar in other respects to conventional travelers' checks.

Figure 2:
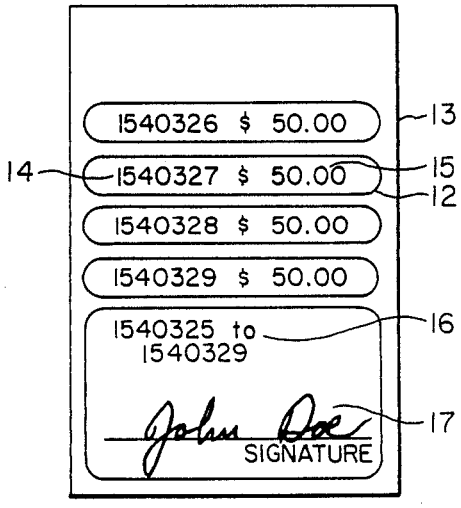
FIG. 2 shows a record sheet, in accordance with the invention, to which a plurality of validation stamps are attached.

FIG. 2 shows a record sheet 13 with validation stamps 12 still attached thereto. The record sheet 13 also contains the range 16 of serial numbers of checks which the customer has purchased, and a space 17 for the customer's signature. As stamps are removed from the record sheet, the customer can keep track of which checks have been used, and which remain.

Figure 3:
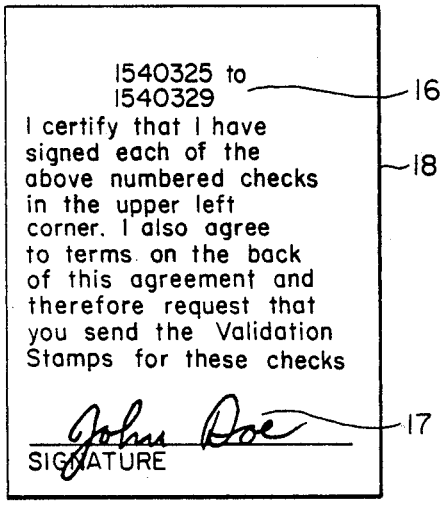
FIG. 3 shows an acknowledgement document, in accordance with the invention, and used in the delivery of checks by mail.

FIG. 3 shows an acknowledgement document 18 which may be used when travelers' checks are ordered by mail, telephone, or other remote manner. This document 18 contains the serial number range 16 of the checks, and the space 17 for the customer's signature.

The operation of the invention is as follows. A customer would order travelers' checks from a vendor (for example, a credit card company) by mail or telephone. The company would send the travelers' checks 11 and an acknowledgement document 18 to the customer, but would not send validation stamps 15. The customer would sign the checks 11 at the top left portion, and also would sign and return the acknowledgement document 18 to the company.

When the signed acknowledgement document 18 is received, the company would send the record sheet 13 with the validation stamps 12 attached. The sheet 13 and stamps 12 may be sent from a distribution center other than the one from which the checks 11 were sent.

The customer would keep the validation stamps 12 in a safe place, separate from the travelers' checks 11. When a check is to be cashed, a validation stamp would be removed from the sheet 13, and placed on the check to be cashed. In addition, the customer would sign the check at the bottom left portion, in the presence of the salesperson or other individual redeeming the check, as is conventional for travelers' checks.

Throughout the above process, there would be no time during which theft, whether in the mail or in any other part of the distribution process, would result in the loss of a negotiable travelers' check. Thus, it would indeed be possible to send travelers' checks through the mail without having to worry about theft. Further, the level of security clearly is much higher than it would be with just the two signature method.

If the checks are stolen, the company which sold the checks can provide a refund in exchange for the validation stamps, and would have confidence that the checks could not be cashed. Likewise, if the validation stamps are stolen, the company can provide a refund to the customer. If somehow both the validation stamps and the checks are stolen, by the same person—an unlikely event, since the stamps and the checks are mailed separately—security still would be no worse than it would be for conventional travelers' checks. If necessary, a data bank of check serial numbers could be referenced through modern computer networks and the like to prevent a refund from being given for both checks and stamps.

While the foregoing describes one specific, presently preferred embodiment, various modifications within the scope and spirit of the invention will be apparent to those of working skill in this field. Thus, the invention should be considered as limited only by the scope of the appended claims which follow immediately.

I claim:

1. A travelers' check system, comprising:

a plurality of travelers' checks, each having a predetermined monetary value printed thereon, said plurality of travelers' checks having a series of serial numbers printed on respective ones thereof so as to define a range, said serial numbers in said series being different from each other said travelers' checks each having a first space for a signature, and a second space for a countersignature;

a record sheet containing a plurality of validation labels, each of said labels having a different respective serial number printed thereon in correspondence with a respective one of said travelers' checks, each of said validation labels further having a predetermined monetary value printed thereon corresponding to a value of said respective one of said travelers' checks;

wherein said travelers' checks are negotiable only when they are combined with the validation label with the same serial number; and an acknowledgement document containing the smallest and the largest of said serial numbers so as to define said range, wherein, in the execution of said travelers' checks system, said acknowledgement document and said validation labels are transmitted separately to a user.

2. A travelers' check system as claimed in claim 1, wherein said plurality of validation labels are adhesive-backed for affixing to one of said travelers' checks.

3. A travelers' check system as claimed in claim 1, wherein at least, one of the plurality of travelers' checks and the plurality of validation labels have holographic images provided thereon.

4. A method of transmitting travelers' checks securely to a customer, said method comprising the following steps:

first transmitting to said customer a plurality of travelers' checks each having a different serial number and a predetermined monetary value printed thereon, said plurality of travelers' checks having a series of serial numbers printed on respective ones thereof so as to define a range, said travelers' checks each having a first space for a signature, and a second space for a countersignature;

transmitting to said customer, either at the same time or subsequently, an acknowledgement document corresponding to said at least one travelers' check, for signature and return by said customer, said acknowledgement document containing thereon a largest one and a smallest one of the serial numbers within said range;

after receipt of said acknowledgement document after signature, transmitting to said customer a plurality of validation labels each having the same serial number and predetermined monetary value in one-to-one correspondence with a respective one of said plurality of travelers' checks.

* * * * *